United States Patent [19]

Hatakeyama

[11] Patent Number: 4,856,921

[45] Date of Patent: Aug. 15, 1989

[54] ROTARY WHEEL PRINTER

[75] Inventor: Osamu Hatakeyama, Morioka, Japan

[73] Assignee: Alps Electric Co., Ltd., Japan

[21] Appl. No.: 625,809

[22] Filed: Jun. 28, 1984

[30] Foreign Application Priority Data

| | | | |
|---|---|---|---|
| Jun. 28, 1983 | [JP] | Japan | 58-98750[U] |
| Jun. 28, 1983 | [JP] | Japan | 58-98752[U] |
| Jun. 28, 1983 | [JP] | Japan | 58-98753[U] |
| Jun. 30, 1983 | [JP] | Japan | 58-100074[U] |
| Jul. 1, 1983 | [JP] | Japan | 58-101040[U] |
| Jul. 1, 1983 | [JP] | Japan | 58-101041[U] |

[51] Int. Cl.[4] ..... B41J 1/24

[52] U.S. Cl. ..... 400/144.2; 400/169; 400/697

[58] Field of Search ..... 400/144.2, 696, 697, 400/697.1, 144.3, 466, 174, 175, 207, 208, 208.1, 196, 196.1, 157.1, 169, 700, 240.1

[56] References Cited

U.S. PATENT DOCUMENTS

| | | | |
|---|---|---|---|
| 3,621,968 | 11/1971 | Kondur | 400/196 X |
| 3,889,795 | 6/1975 | Garberi et al. | 400/208 |
| 3,974,906 | 8/1976 | Lee et al. | 400/196.1 |
| 4,307,971 | 12/1981 | Kane, III et al. | 400/697 |
| 4,308,794 | 1/1982 | Adamoli et al. | 400/144.2 X |
| 4,353,657 | 10/1982 | Schaefer | 400/696 X |
| 4,386,864 | 6/1983 | Wang et al. | 400/144.2 X |
| 4,443,123 | 4/1984 | Ono et al. | 400/146 X |

FOREIGN PATENT DOCUMENTS

| | | | |
|---|---|---|---|
| 1561261 | 2/1970 | Fed. Rep. of Germany | 400/144.2 |
| 84967 | 7/1981 | Japan | 400/174 |
| 120383 | 9/1981 | Japan | 400/697.1 |
| 137985 | 10/1981 | Japan | 400/697 |
| 38149 | 3/1982 | Japan | 400/144.2 |

OTHER PUBLICATIONS

IBM Technical Disclosure Bulletin, vol. 18, No. 2, Jul. 1975, p. 371, "Type Disk-Hammer Detent" by Harrington et al.

*Primary Examiner*—Charles A. Pearson

*Attorney, Agent, or Firm*—Guy W. Shoup; Paul J. Winters

[57] ABSTRACT

A rotary wheel printer such as a daisy wheel printer comprises a rotatable platen for winding a print paper sheet partially therearound, a carriage movable along the platen, a type wheel mounted on the carriage in confronting relation to the platen and having a plurality of type fonts and a correcting section. First drive means are mounted on the carriage for driving the type wheel to rotate about its own axis, and hammer means are also mounted on the carriage for moving toward one of the type fonts or one of the correcting sections while it is held at rest in a printing position. Second drive means are mounted on the carriage for driving the hammer means, and ribbon feeder means are provided for successively feeding ink ribbon accommodated in a ribbon cassette mounted on the carriage and a correcting ribbon accommodated in the ribbon cassette. Third drive means are mounted on the carriage for driving the ribbon feeder means, and correcting means comprising the correcting section of the type wheel, the correcting ribbon, and hammer means for correcting a printed character from the paper sheet by striking the correction ribbon are provided.

8 Claims, 11 Drawing Sheets

ROTARY WHEEL PRINTER

BACKGROUND OF THE INVENTION

The present invention relates to a daisy wheel printer, and more particularly, to such a printer which is small in size.

Conventional daisy wheel printers include a petal-shaped wheel having a plurality of bars extending radially and carrying type fonts on their end portions for printing characters by impact on a paper sheet wrapped partially around a rotatable platen. A hammer is provided for striking the type fonts one at a time against an ink ribon disposed between the paper sheet and the type fonts at the time of printing a desired character, and a correcting ribbon is often provided between the paper sheet and the type font when it is desired to correct a printed character.

The petal-shaped wheel or daisy wheel in the conventional printer is, however, generally disposed vertically and hence the printer body has a high vertical dimension. The vertical daisy wheel, therefore, is disadvantageous in that it cannot be used in smaller printers.

The prior daisy wheel printers also require a first drive mechanism for moving the ink ribbon along the axis of the platen, a second drive mechanism for moving the correcting ribbon along the axis of the platen, a lifting and lowering mechanism for lifting and lowering the ink ribbon and correcting ribbon in a direction normal to the axis of the platen when a printed character is to be corrected, and a memory for storing data for characters printed on the print paper sheet to allow printed characters to be corrected. Such printers are, therefore, complex in construction, costly to manufacture, and require complicated control modes.

SUMMARY OF THE INVENTION

With the foregoing conventional drawbacks in view, it is an object of the present invention to provide a rotary wheel printer including a printer body of a reduced height.

Another object of the present invention is to provide a rotary wheel printer having a correcting mechanism of a simple construction.

Still another object of the present invention is to provide a rotary wheel printer having a ribbon cassette containing a correcting ribbon, a type wheel including a correcting section, and simplified control means for correcting printed characters.

According to the present invention, a rotary wheel printer comprises a rotatable platen for receiving a paper sheet partially therearound, and a carriage movable along the platen. A type wheel is mounted on the carriage in confronting relation to the platen and has a plurality of type fonts and a correcting section. First drive means are mounted on the carriage for driving the type wheel to rotate it about its own axis, while hammer means are mounted on the carriage for moving toward one of the type fonts or the correcting section. Second drive means are mounted on the carriage for driving the hammer means, and ribbon feeder means are provided for successively feeding an ink ribbon accomodated in a ribbon cassette mounted on the carriage or a correcting ribbon accomodated in the ribbon cassette. Third drive means are mounted on the carriage for driving the ribbon feeder means, and correcting means are provided by the correcting section of the type wheel, the correcting ribbon, and the hammer means for correcting a printed character on the paper sheet.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 1(*b*) is a side elevational view of the carriage shown in FIG. 1(*a*);

FIG. 2(*b*) is a fragmentary perspective view of a hammer head of the rotary wheel printer of FIG. 1(*a*);

FIG. 3(*b*) is a fragmentary side elevational view of the correcting mechanism.

FIG. 4(*b*) is a plan view of the mechanism illustrated in FIG. 4(*a*);

FIG. 6(*b*) is a fragmentary side elevational view showing a correcting operation;

FIGS. 8(*b*), 8(*d*) and 8(*f*) are sectional side elevational views partially in section of the drive means, corresponding to FIGS. 8(*a*), 8(*c*) and 8(*e*), respectively.

FIG. 11(*b*) is a fragmentary rear elevational view of a type wheel of the correcting mechanism, for use with the hammer head of FIG. 11(*a*);

FIG. 11(*c*) is a fragmentary side elevational view of the correcting mechanism of FIGS. 11(*a*) and 11(*b*), showing a standby position;

FIG. 11(*d*) is a fragmentary side elevational view of the correcting mechanism of FIG. 11(*c*), showing a printing operation;

FIG. 11(*e*) is a fragmentary side elevational view of the correcting mechanism of FIG. 11(*c*), showing a correcting operation;

FIG. 11(*f*) is a fragmentary perspective view of still another hammer head;

DESCRIPTION OF THE PREFERRED EMBODIMENTS

FIGS. 1 through 8 illustrate a rotary wheel printer constructed in accordance with an embodiment of the present invention.

Figure 1A:
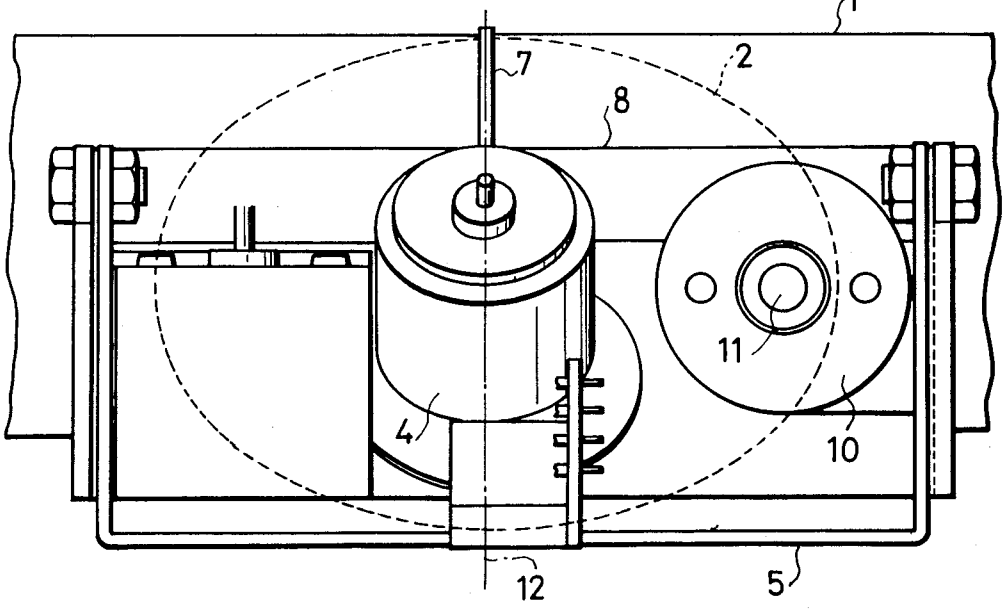
FIG. 1(*a*) is a rear elevational view of a carriage of a rotary wheel printer according to the present invention.
Figure 1B:
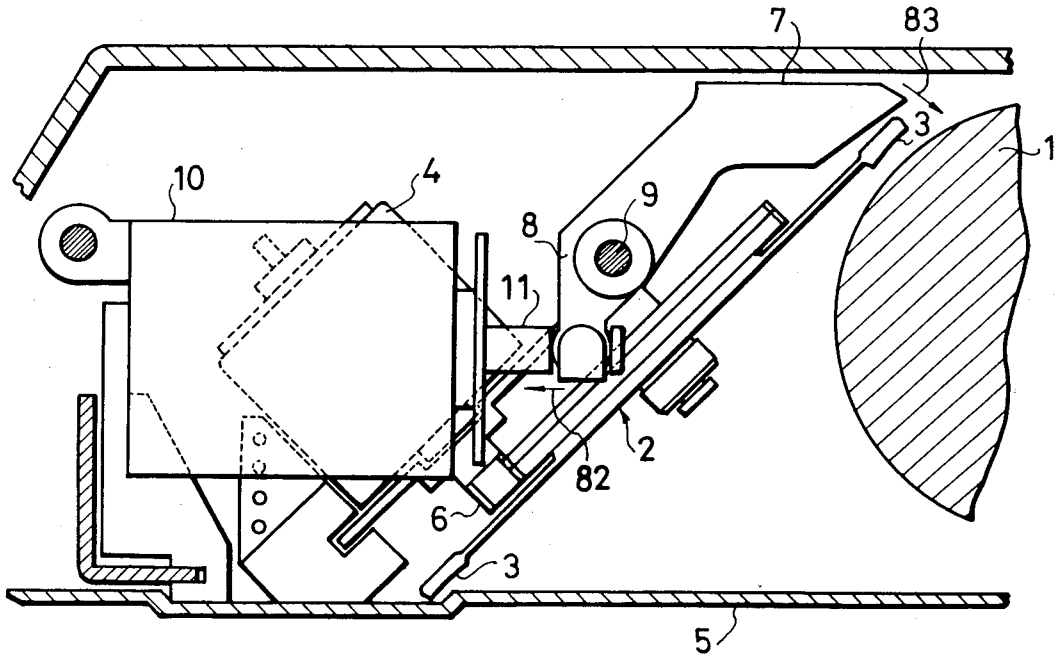

FIGS. 1(*a*) and 1(*b*) show a carriage for the rotary wheel printer. A paper sheet (not shown) is held partially around a platen 1, and a type wheel 2 is disposed in confronting relation to the platen 1. The type wheel 2 comprises a daisy wheel or petal-shaped wheel having a plurality of radial bars each supporting respective type fonts 3 on their distal ends. The type wheel 2 is inclined with respect to the horizonal plane at an angle ranging from 30 degrees to 60 degrees, and for example, the type wheel 2 of the embodiment of FIGS. 1(*a*) and 1(*b*) is inclined at an angle of 45 degrees. The type wheel 2 can be rotated about its central axis by a motor 4 mounted by a support onto a chassis 5 which forms part of the body of a movable carriage.

A hammer 7 has an integral hammer lever 8 and is mounted on a shaft 9 for angular movement to strike the type fonts 3 placed in a printing position one at a time. The hammer 7 can be angularly moved by a solenoid 10 mounted by a support onto the chassis 2 and having shaft 11 engaging the hammer lever 8. The hammer lever 8 and the solenoid 10 jointly constitute a hammer turning mechanism, described below.

The motor 4 is arranged such that the central axis of the output shaft 6 of the motor 4 lies in a plane containing the path of angular movement of the hammer 7, that is, a plane 12 extending perpendicularly to the axis of the platen 1 and shown by the dot-and-dash line in FIG. 1(*a*). The solenoid 10 is spaced from the plane 12 laterally of the motor 4, as shown in FIG. 1(*a*).

Figure 2A:
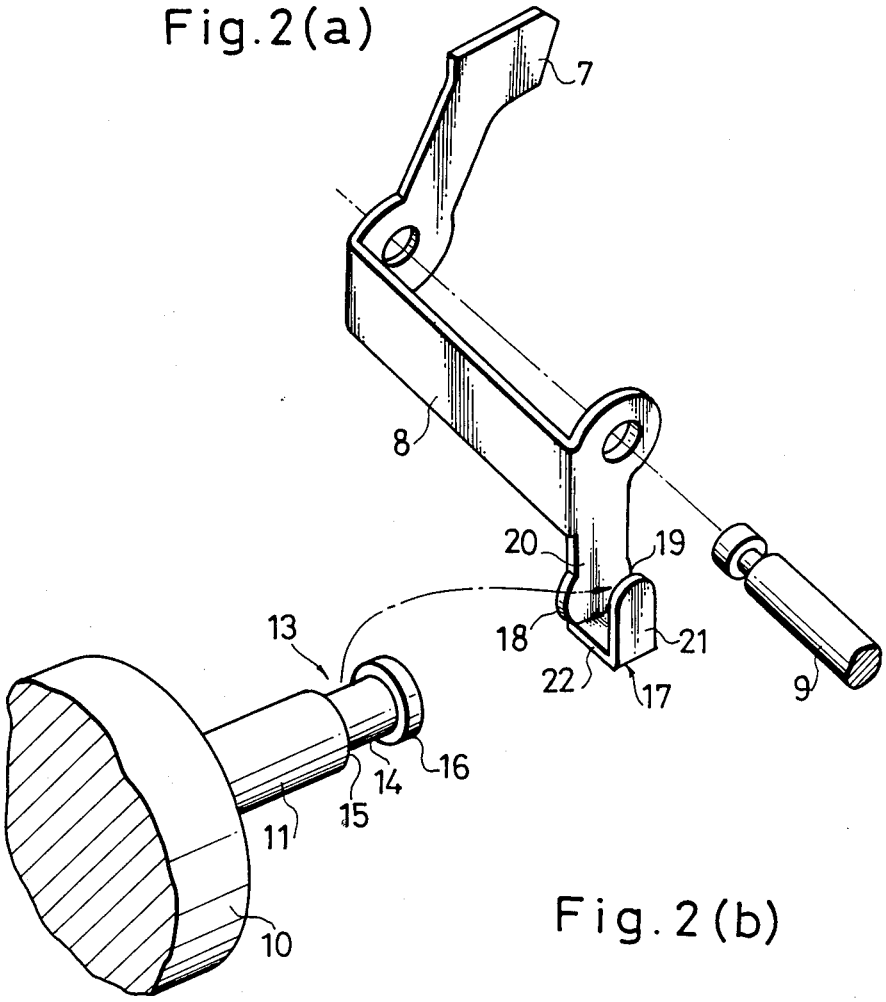
FIG. 2(*a*) is an exploded perspective view of a hammer turning mechanism in the rotary wheel printer of FIG. 1(*a*)
Figure 2B:
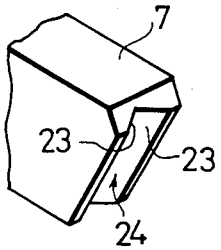

FIG. 2(*a*) is an exploded perspective view of the hammer turning mechanism, and FIG. 2(*b*) is a perspective view of the head of the hammer 7. As shown in FIG. 2(*a*), the shaft 11 of the solenoid 10 has an engagement end 13 engaging the hammer lever 8 and including a smaller-diameter neck portion 14 defined by spaced flat end surfaces 15 and 16 contiguous to the ends of the neck portion 14. The hammer lever 8 also has an engagement end 17 engaging the shaft 11 of the solenoid 10 and comprised of a first upstanding portion 20 having curved edges 18 and 19 on its lower portion, a second upstanding potion 21 spaced from the first upstanding portion 20 in confronting relation thereto, and a base portion 22 interconnecting the first and second upstanding portions 20 and 21. The first and second upstanding portions 20 and 21 and the base portion 22 together are formed into a channel shape. The engagement portions 13 and 17 are held in engagement with each other with the smaller-diameter neck portion 14 sandwiched between the first and second upstanding portions 20 and 21, and the curved edges 18 and 19 held respectively against the flat end surfaces 15 and 16 of the neck portion 14. As shown in FIG. 2(*b*), the head of the hammer 7 has a recess 24 having its front surfaces 23 tapered.

Figure 3A:
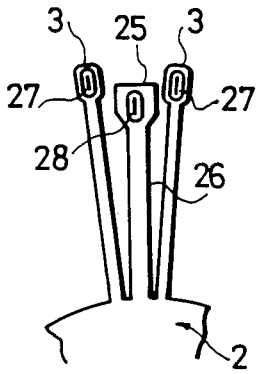
FIG. 3(*a*) is a fragmentary rear elevational view of a correcting mechanism for the rotary wheel printer.
Figure 3B:
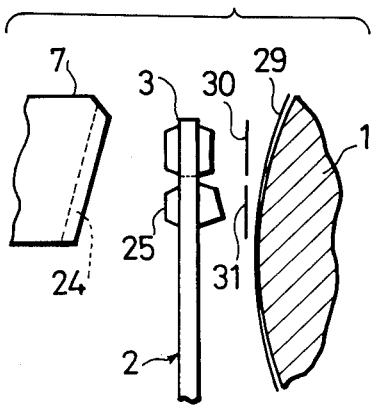

FIGS. 3(*a*) and 3(*b*) are rear and side elevational views, respectively, of a correcting mechanism in the rotary wheel printer. The correcting mechanism has a correcting character 25 supported on a correcting spoke 26. As shown in FIG. 3(*a*), the correcting spoke 26 is integrally formed with the type wheel 2 having the type fonts 3. As illustrated in FIG. 3(*b*), the correcting character 25 is located in a position lower than the type fonts, but can still be struck by the hammer 7. In FIG. 3(*a*), the rear surfaces of the type fonts 3 and correcting character 25 have ridges 27 and 28 having tapered surfaces fitting within the recess 24 in the front surface of the head of the hammer 7. A paper sheet 29 is held partially around the platen 1, as shown in FIG. 3(*b*), and ink and correcting ribbons 30 and 31, respectively, are adapted to be struck by the type fonts 3 and correcting characters 25 of the type wheel 2.

Figure 4A:
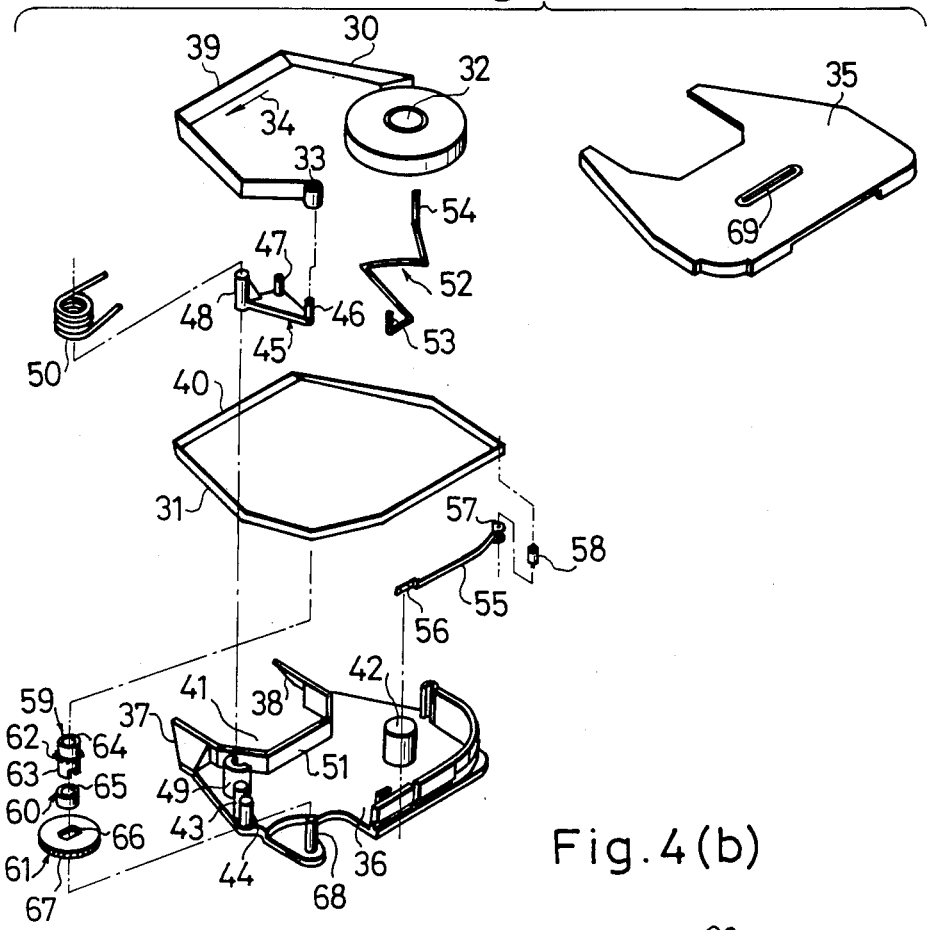
FIG. 4(*a*) is an exploded perspective view of a mechanism for moving the ink and correcting ribbons in coaction with each other.
Figure 4B:
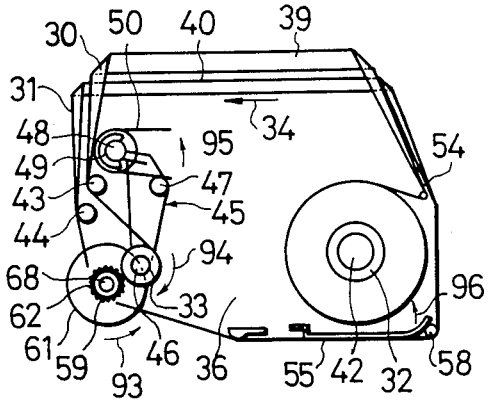

FIG. 4(*a*) is an exploded perspective view of a mechanism for moving the ink and correcting ribbons in coaction with each other, and FIG. 4(*b*) is a plan view of the mechanism of FIG. 4(*a*). In FIGS. 4(*a*) and 4(*b*), the ink ribbon 30 has ends fastened to spools 32 and 33, respectively, and is transported in preset increments along the axis of the platen 1 in a direction normal to the direction of the feed of the paper sheet 29, as shown by the arrow 34 in FIG. 4(*b*), each time one character is printed. The correcting ribbon 31 is endless and disposed below the ink ribbon 30. The ink and correcting ribbons 30 and 31 are retained in a cassete composed of upper and lower casings 35 and 36, and are movable in the direction normal to the direction of feed of the paper sheet 29. The upper and lower cassette casings 35 and 36 are separably retained together by suitable engagement means.

The lower cassette casing 36, for example, has front arms 37 and 38 positioned near the platen 1 and includes slanted surfaces 37 and 38 inclined at the angle at which the type wheel 2 is inclined with respect to the horizontal plane, as shown in FIG. 4(*a*). The ink and correcting ribbons 30 and 31 provide respective runs 39 and 40 located closely to the platen 1 and directed by the front arms 37 and 38 of the lower cassette casing 36 so that the runs 39 and 40 are inclined with respect to the horizontal plane at the same angle the type wheel 2 is inclined with respect to the horizontal plane. The front arms 37 and 38 of the lower cassette casing 36 define a clearance 41 therebetween in which the hammer 7 and the type fonts 3 or correcting character 25 of the type wheel 2 can be disposed.

The lower cassette casing 36 has a shaft 42 on which the spool 32 for the ink ribbon 30 is rotatably mounted, a first guide shaft 43 for guiding the ink ribbon 30, and a second guide shaft 44 for guiding the correcting ribbon 31. A swingable body 45 has a pin 46 on which the spool 33 of the ink ribbon 30 is mounted, and another pin 47, as well as a pivot shaft 48. The swingable body 45 is swingably held on the lower cassette casing 36 with the pivot pin 47 rotatably supported by a bearing 49 on the lower cassette casing 36. A torsion coil spring 50 has a central coil portion fitted over the bearing 49 of the lower cassette casing 36, with one end of the spring 50 held in engagement with the pin 47 of the swingable body 45 and an opposite end held against a wall surface 51 of the lower cassette casing 36. The torsion coil spring 50 serves to normally urge the swingable body 45 to turn about the pivot shaft 48 clockwise as shown in FIG. 4(*b*).

A wire spring 52 as shown in FIG. 4(*a*) has one end 53 fixed to the lower cassette casing 36 and an opposite end 54 engaging the ink ribbon 30 wound around the spool 32 for tensing the ink ribon 30 and imposing a resilient force to prevent the ink ribon 30 wound on the spool 32 from loosening. A leaf spring 55 has one end 56 fixed to the lower cassette casing 36 and an opposite end 57 supporting a roller 58 urging the correcting ribon 31. The leaf spring 55 and the roller 58 jointly constitute a means for urging the correcting ribbon 31 outwardly for tensing the correcting ribbon 31.

The ink ribbon 30 can be fed along by an ink ribbon feeder 59. As shown clearly in FIG. 4(*a*) and FIG. 5(*a*) a rotatable body 60 formed, for example, by a rubber roller is disposed below the ink ribbon feeder 59. A manual feeder gear 61 is located beneath the rubber roller 60. The ink ribbon feeder 59 comprises a barrel having teeth 62 for biting engagement with the portion of the ink ribbon 30 wound around the spool 33 and includes a lower portion 63 of an elliptical cross section, the barrel having a vertical through hole 64. The rubber roller 60 has a hole 65 in which the lower portion 63 of the ink ribbon feeder 59 is fitted. The correcting ribbon 31 can be held partially around the rubber roller 60. The manual feeder gear 61 has a central hole 66 of an elliptical shape in which the lower portion 63 of the ink ribbon feeder 59 is fitted, and also has peripheral gear teeth 67. The ink ribbon feeder 59, the rubber roller 60, and the manual feeder gear 61 are assembled as a unit and rotatably mounted on a shaft 68 on the lower cassette casing 36 for being rotated in unison by a DC motor, described below.

The shaft 68, the ink ribbon feeder 59, the rubber roller 60, and the manual feeder gear 61 jointly constitute a mechanism for moving the ink ribbon 30 and the correcting ribbon 31 together in the direction of the arrow 35.

The upper cassete casing 35 has a window 69 for visually indicating the length of the ink ribbon 32 which has been wound around the spool 33.

Figure 5:
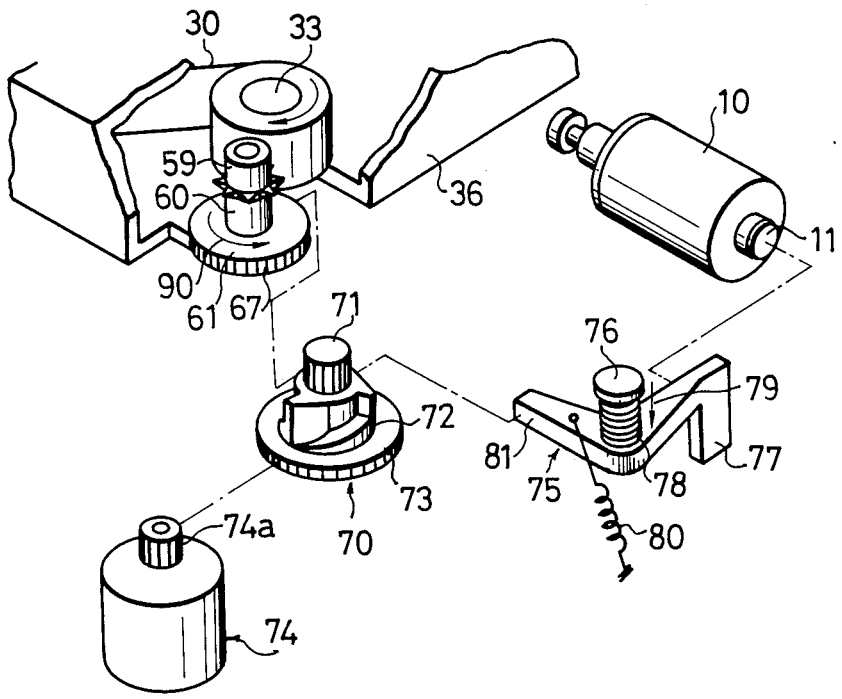
FIG. 5 is an exploded perspective view of a drive means for driving the mechanism shown in FIGS. 4(*a*) and 4(*b*)

FIG. 5 shows in exploded perspective a drive means for driving the mechanism shown in FIGS. 4(*a*) and 4(*b*).

FIG. 5 also shows the lower cassette casing 36, the ink ribbon 30, the ink ribbon feeder 59, the rubber roller 60, the manual feeder gear 61, the gear teeth 67 of the manual feeder gear 61, the solenoid 10 for turning the hammer 7, and the shaft 11 of the solenoid 10. A rotatable body 70 rotatably supported on the chassis 5 has an upper gear 71 engageable with the gear teeth 67 of the manual feeder gear 61, a central cam 72, and a lower gear 73. A DC motor 74 has an output shaft including a gear 74*a* meshing with the lower gear 73 of the rotatable body 70 and is supported on the chassis 5, for example. A lever 75 is supported for angular movement by a pin 76 on the chassis 5, and includes a leg 77 engageable with the shaft 11 of the solenoid 10. A coil spring 78 is disposed around the pin 76 for normally urging the lever 75 downwardly in the direction of the arrow 79 in FIG. 5. Another coil spring 80 has one end engaging the lever 75 and an opposite end engaging the chassis 5 for normally urging an end 81 of the lever 75 into engagement with the cam 72 of the rotatable body 70.

The rotatable body 70 with the gears 71, 73 and the cam 72, the DC motor 74 with the gear 74*a*, the lever 75, the pin 76, and the coil springs 78, 80 jointly constitute the drive means for moving the ink ribbon 30 in the direction of the arrow 34 in FIG. 4(*a*) in response to operation of the solenoid 10.

Operation of the rotary wheel printer thus constructed will be described.

Figure 6A:
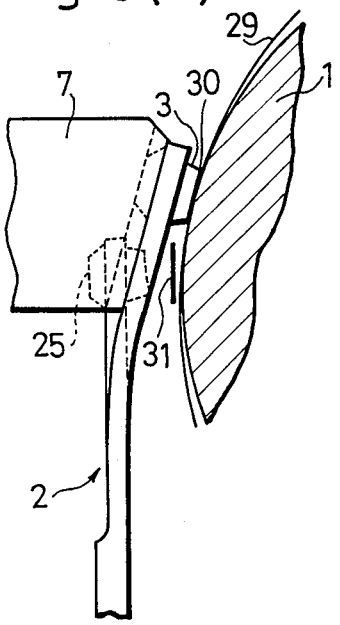
FIG. 6(*a*) is a fragmentary side elevational view showing a printing operation.
Figure 6B:
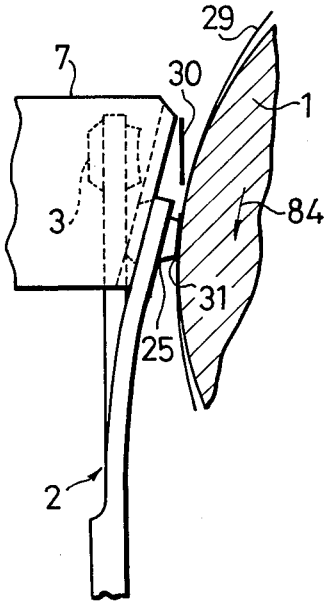
Figure 7A:
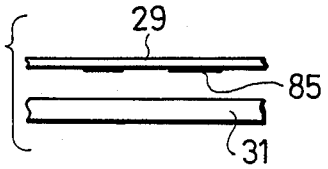
FIGS. 7(*a*) through 7(*d*) are fragmentary plan views illustrative of progressive steps of the correcting operation.
Figure 7C:
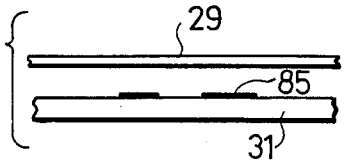
Figure 7B:
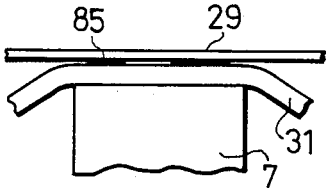
Figure 7D:
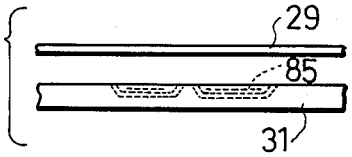
Figure 8A:
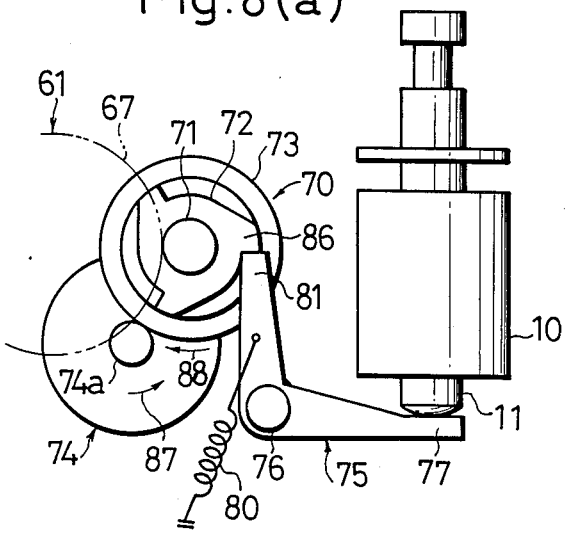
FIGS. 8(*a*), 8(*c*) and 8(*e*) are views showing operations of the drive means illustrated in FIG. 5.
Figure 8B:
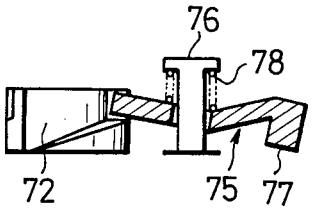
Figure 8C:
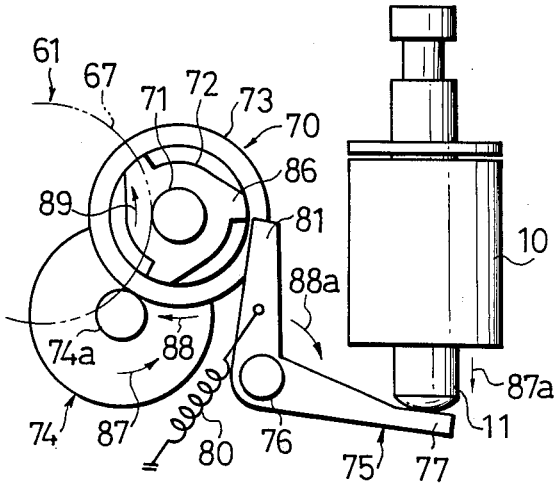
Figure 8D:
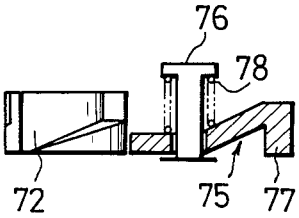
Figure 8E:
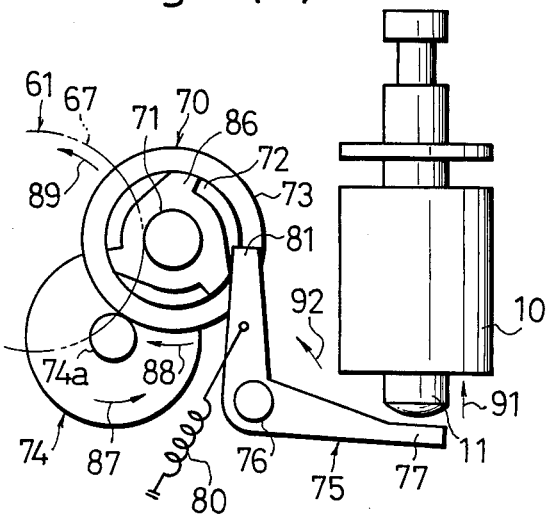
Figure 8F:
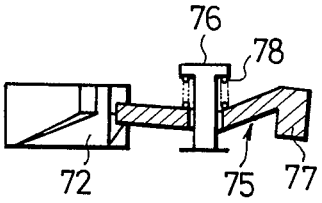

For effecting a printing operation, the motor 4 is energized in the condition of FIG. 1(*b*) to rotate the type wheel 2 by engagement of a gear on the end of the motor shaft 6 and a gear fixed to the rear side of the type wheel. When a desired type font 3 is brought into confronting relation to a print position on the paper sheet 29, the motor 4 is de-energized to stop the rotation of the type wheel 2. Then, the solenoid 10 is energized to move the shaft 11 thereof in the direction of the arrow 82 in FIG. 1(*b*) to cause the hammer lever 8 to turn the hammer 7 about the shaft 9 in the direction of the arrow 83 in FIG. 1(*b*), thereby striking the rear of the selected type font 3 as shown in FIG. 6(*a*) to press the ink ribbon 30 against the paper sheet 39 held around the platen 1. A desired character is thus printed on the paper sheet 29.

For correcting a printed character, the motor 4 is energized in the condition of FIG. 1(*b*) to rotate the type wheel 2 until a desired correcting character 25 is brought into confronting relation to the printed character on the paper sheet 29 which is to be corrected. When the desired correcting character 25 has arrived at the printed character to be corrected, the motor 4 is inactivated to stop the rotation of the type wheel 2. Then, the solenoid 10 is activated to move the shaft 11 thereof in the direction of the arrow 82 in FIG. 1(*b*) to cause the hammer lever 8 to turn the hammer 7 about the shaft 9 in the direction of the arrow 83 in FIG. 1(*b*), thereby striking the correcting character 25 as shown in FIG. 6(*b*) to press the correcting ribbon 31 against the paper sheet 29 held around the platen 1 to correct the erroneous character.

At this time, the carriage may be held at rest, and the correcting ribbon 31 may be hit by the hammer 7 a number of times while the platen 1 is being turned through small angles to move the print paper sheet 29 as indicated by the arrow 84 in FIG. 6(*b*). Alternatively, the platen 1 and hence the print paper sheet 29 may be held at rest, and the correcting ribbon 31 may be hit by the hammer at a number of times while the carriage is being moved through small intervals along the axis of the platen 1.

FIGS. 7(*a*) through 7(*d*) illustrate progressive steps of the foregoing correcting operation. Designated in FIGS. 7(*a*) through 7(*d*) at 85 are layers of ink which form printed characters on the paper sheet 29.

Prior to the correcting operation, the correcting ribbon 31 is spaced from the print paper sheet 29 as illustrated in FIG. 7(*a*). By hitting the correcting ribbon 31 with the hammer 7, the correcting ribbon 31 is pressed against the print paper sheet 29 as shown in FIG. 7(*b*). As the hammer 7 is retracted, the ink layers 85 are attached to the correcting ribbon 31 to thereby lift the corresponding printed characters off the print paper sheet 29 as shown in FIG. 7(*c*). The ink layers deposited on the correcting ribon 31 will be absorbed and dispersed into the correcting ribbon 31 with time as shown in FIG. 7(*d*). Therefore, the correcting ribbon 31 is capable of correcting printed characters a number of times on the same location on the correcting ribbon 31.

As described above with reference to FIG. 2(*a*), the upstanding portion 20 of the hammer lever 8 has the curved edges 18 and 19 which are held against the flat end surfaces 15 and 16 of the shaft 11 of the solenoid 10, and the smaller diameter neck portion 14 of the shaft 11 is sandwiched between the upstanding portions 20 and 21. This arrangement prevents any unwanted wobbling movement of the curved edges 18, 19 and the end surfaces 15, 16 relative to each other, and of the upstanding portions 20, 21 and the smaller-diameter neck portion 14 relative to each other, thus allowing the hammer lever and hence the hammer to turn smoothly in printing and correcting operations.

As shown in FIG. 2(*b*), the front surface of the head of the hammer 7 has the recess 24 with the tapered surface 23. In addition, as shown in FIG. 3(*a*), the rear surfaces of the type fonts 3 and correcting characters 25 of the type wheel 2 have the ridges 27 and 28 with the tapered surfaces engageable in the recess 24. When the type fonts 3 and correcting characters 25 are struck by the hammer 7, the ridges 27 and 28 on the rear surfaces of the type fonts 3 and corecting characters 25 are guided by the tapered surfaces 23 on the hammer 7 into the recess 24. Therefore, even when the type fonts 3 and correcting characters 25 are slightly out of position at the time the type wheel 2 is held at rest, and they are struck by the hammer, the type fonts 3 and correcting characters 25 can be properly positioned in alignment with the hammer 7 for printing and correcting operations.

As the hammer 7 is turned, the drive means shown in FIG. 5 operates through steps shown in FIGS. 8(*a*) through 8(*f*). FIG. 8(*a*) is a plan view showing a standby position before the hammer 7 strikes a type fonts 3, FIG. 8(*b*) a side elevational view, partly in section, of the parts shown in FIG. 8(*a*); FIG. 8(*c*) is a plan view showing a position in which the hammer strikes the type font 3, FIG. 8(*d*) a side elevational view, partly in section, of parts shown in FIG. 8(*c*); FIG. 8(*e*) is a plan view showing the hammer 7 as it returns to the standby position, and FIG. 8(*f*) side elevational view, partly in section, of the parts shown in FIG. 8(*e*).

When the hammer 7 is in the standby position or in the position shown in FIG. 1(*b*), the end 81 of the lever 75 is caused by the coil spring 80 to engage a projecting portion 86 of the cam 72 of the rotatable body 70, with the leg 77 of the lever 75 held against the shaft 11 of the solenoid 10. Under this condition, turning movement of the gear 74*a* of the DC motor 74 in the direction of the arrow 87 FIG. 8(*a*) results in the projecting portion 86 of the cam 72 engaging the end 81 of the lever 75 to thereby prevent the cam 72 from turning in the direction of the arrow 88, whereupon the cam 72 and hence the rotatable body 70 are locked against further rotation.

When the hammer 7 strikes a type font 3, or the hammer 7 is to turn, the shaft 11 of the solenoid 10 is moved in the direction of the arrow 87*a* as shown in FIGS. 8(*c*) to turn the lever 75 in the direction of the arrow 88*a* against the force of the spring 80 until the end 81 of the lever 75 is disengaged from the projecting portion 86 of the cam 72. The cam 72, that is the rotatable body 70, is then unlocked. On turning movement of the gear 74*a* of the DC motor 74 in the direction of the arrow 87, the gear 73 of the rotatable body 7 is turned in the direction of the arrow 88, and the cam 72 and the gear 71 are turned in unison in the direction of the arrow 88. As the gear 71 of the rotatable body 70 is turned in the direction of the arrow 88, the gear teeth 67 of the manual feeder gear 61 are turned in the direction of the arrow 89 in FIG. 8(*c*), that is in the direction of the arrow 90 in FIG. 5, to thereby advance the ink ribbon 30.

After the hammer 7 has hit the type font 3 and returned to the standby position shown in FIG. 1(*b*), the shaft 11 of the solenoid 10 is moved in the direction of the arrow 91 as illustrated in FIG. 8(*e*) to allow the lever 75 to turn in the direction of the arrow 92 under the force of the coil spring 80. The cam 72 and hence the rotatable body 70 with the gears 71, 73 are turned in the direction of the arrow 88 in response to the turning movement of the gear 74*a* of the DC motor 74 in the direction of the arrow 87, until the next projection portion 86 of the cam 72 engages the end 81 of the lever 75. The manual feeder gear 61 continues to turn in the direction of the arrow 89 to advance the ink ribbon 30.

When the projecting portion 86 of the cam 72 engages the end 81 of the lever 75, the cam 72 or the rotatable body 70 is locked as shown in FIG. 8(*a*).

While the shaft 11 of the solenoid 10 moves in one reciprocating cycle, that is, the hammer 7 makes one striking movement against a type font 3, the cam 72 or the rotatable body 70 is angularly moved through an angle such as 60 degrees to enable the ink ribbon feeder 59 to feed the ink ribbon 30 a distance corresponding to one character to be printed.

As the manual feeder gear 61 is turned in the direction of the arrow 90 in FIG. 5 or the direction of the arrow 93 in FIG. 4(*b*) in response to turning movement of the rotatable body 70 or the gear 71, the rubber roller 60 and the ink ribbon feeder 59 shown in FIG. 4(*a*) are turned in the direction of the arrow 93 in FIG. 4(*b*) in unison with the manual feeder gear 61.

On the turning movement of the ink ribbon feeder 59 in the direction of the arrow 93 in FIG. 4(*b*), the teeth 62 of the ink ribbon feeder 59 are brought into biting engagement with the portion of the ink ribbon 30 wound around the spool 33 which is urged by the coil spring 50 to move toward the ink ribbon feeder 59, thereby causing the portion of the ink ribbon 30 wound around the spool 33 to turn in the direction of the arrow 94 in FIG. 4(*b*). The ink ribbon 30 is now moved in the direction of the arrow 34 and wound around the spool 33. The swingable body 45 shown in FIGS. 4(*a*) and 4(*b*) is progressively turned in the direction of the arrow 95 in FIG. 4(*b*) as the length of the ink ribbon 30 wound on the spool 33 increases.

The turning movement of the rubber roller 60 in the direction of the arrow 93 in FIG. 4(*b*) causes the correcting ribbon 30 to move in the direction of the arrow 34 in FIG. 4(*b*). Therefore, the ink ribbon 30 and the correcting ribbon 30 are moved in synchronism with each other. While the ink and correcting ribbons 30 and 31 are being thus moved, they are guided by and along the the front arms 37 and 38 of the lower cassette casing 36.

Any sagging in the ink ribbon 30 can be taken up by manually turning the manual feeder gear 61 while the cassette with the ink ribbon 30 accomodated therein is mounted on the carriage.

The rotary wheel printer of the foregoing construction has the following advantages: The vertical dimensions of the printer body can be reduced since the type wheel 2 is inclined in the horizontal plane as shown in FIG. 1(*b*).

The output shaft 6 of the motor 4 for rotating the type wheel 2 has its central axis lying in the plane 12 containing the path of turning movement of the hammer 7, and the solenoid 10 for turning the hammer 7 is located laterally of the motor 4. This arrangement also contributes to a reduction in the height of the printer body.

As described above, the curved edges 18 and 19 of the upstanding portion 20 of the engagement portion 17 of the hammer lever 8 are held respectively against the flat end surfaces 15 and 16 of the engagement portion 13 of the shaft 11 of the solenoid 10, as shown in FIG. 2(*a*). This enables movement of the shaft 11 of the solenoid 10 to be converted smoothly into turning movement of the hammer 7. Therefore, the hammer 7 can operate in accurately timed relation to operation of the solenoid 10 at all times, and hence will have excellent performance.

Since the ink ribbon 30 and the correcting ribbon 31 are moved in unison in a direction normal to the direction of feed of the print paper sheet 29 by the mechanism comprised of the ink ribbon feeder 59, the rubber roller 60, and the manual feeder gear 61, the means for moving in the ink ribbon 30 and the correcting ribbon 31 can be of a simple construction.

As shown in FIGS. 4(*a*) and 4(*b*), the ink ribbon 30 and the correcting ribbon 31 are accommodated in the cassette composed of the upper and lower cassette casing 35 and 36, the ink ribbon 30 and the correcting ribbon 31 can thus be mounted and detached from the carriage easily.

Since any correcting operation can be performed without a separate mechanism for lifting and lowering the ink and correcting ribbons 30 and 31, the control required for correcting printed characters is simplified.

By displacing the leaf spring 55 shown in FIGS. 4(*a*) and 4(*b*) in the direction of the arrow 96 in FIG. 4(*b*), the correcting ribbon 31 can easily be removed from and mounted in the lower cassette casing 36 without detaching the upper cassette casing 35 from the lower cassette casing 36. As a consequence, the correcting ribbon 31 can easily be replaced with a new one.

As illustrated in FIG. 4(*a*), the front arms 37 and 38 of the lower cassette casing 36 have slanted surfaces inclined at the angle equal to the angle at which the type wheel 2 is inclinded to the horizontal plane. Accordingly, the ink ribbon 30 and the correcting ribbon 31 can be arranged parallel to the type fonts 3 and correcting characters 25, respectively, on the type wheel 2 for reliable printing and correcting operations.

Since the type wheel 2 has the spokes 26 carrying the correcting characters 25 are movable in small increments to correct a printed character, the rotary wheel printer of the invention requires no memory for storing data on the characters on the type fonts 3 of the type wheel 2 which are printed on the paper sheet 29 for correcting any characters printed on the print paper sheet 29. Therefore, the type wheel 2 can easily be controlled in a character correcting mode.

Figure 9:
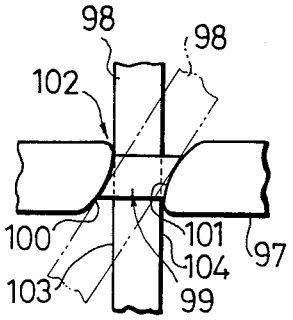
FIG. 9 is a fragmentary view of another hammer turning mechanism.
Figure 10:
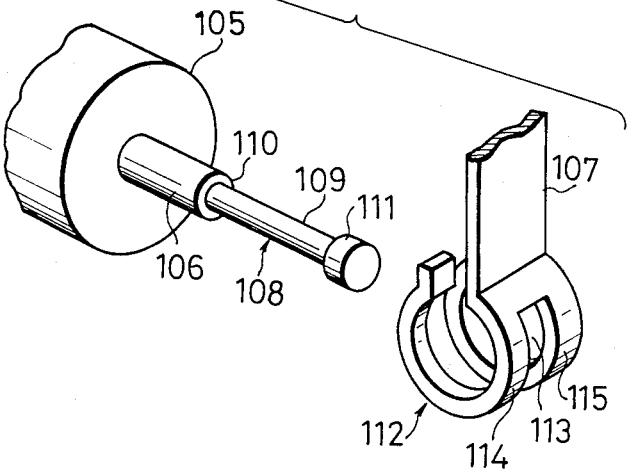
FIG. 10 is an exploded perspective view of still another hammer turning mechanism.
Figure 11A:
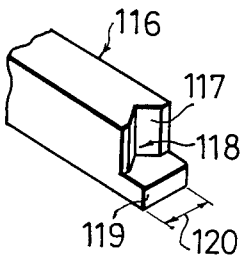
FIG. 11(*a*) is a fragmentary perspective view of a hammer head of a correcting mechanism according to another embodiment.
Figure 11B:
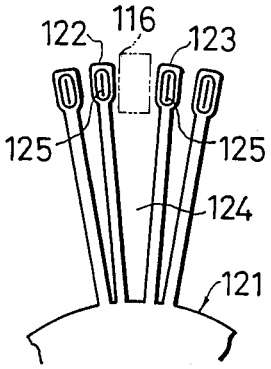
Figure 11C:
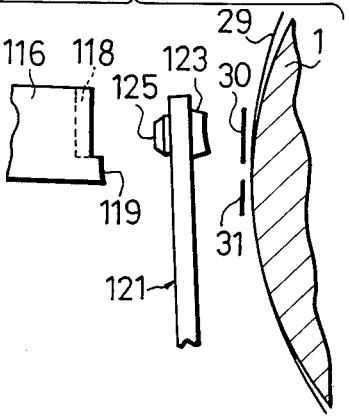
Figure 11D:
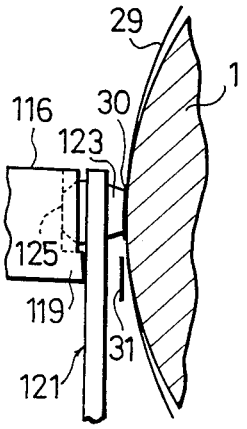
Figure 11E:
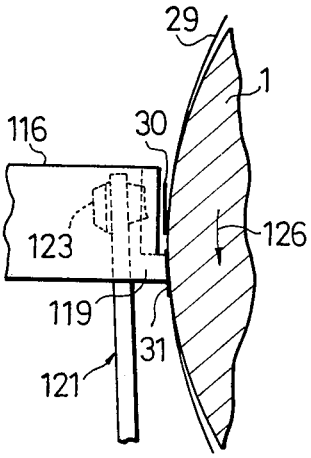
Figure 11F:
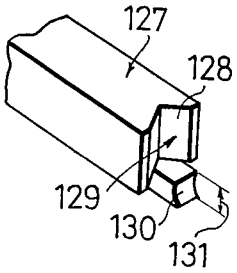

FIGS. 9 and 10 illustrate hammer turning mechanisms according to other embodiments.

As shown in FIG. 9, a solenoid shaft 97 serves to turn the hammer 7, and a hammer lever 98 is coupled to the hammer 7. The solenoid shaft 97 has an engagement protion 102 engaging the solenoid shaft 97 and having flat end surfaces 103 and 104 held respectively against the cam surfaces 100 and 101. The hammer lever 98 as depicted by the solid lines is in a standby position, and the hammer lever 98 as depicted by the dot-and-dash lines is in a position in which the hammer strikes a type font.

The hammer turning mechanism shown in FIG. 9 can turn the hammer lever 98 and hence the hammer 7 smoothly in coaction with movement of the solenoid shaft 97.

According to the embodiment shown in FIG. 10, the hammer 7 is turned by a solenoid 105 having a shaft 106, and a hammer lever 107 is connected to the hammer 7. The shaft 106 of the solenoid 105 has an engagement portion 108 held in engagement with the hammer lever 107 and having a smaller-diameter neck portion 109 defined by flat end surfaces 110 and 111. The hammer lever 107 includes an engagement portion 112 held in engagement with the shaft 106 and constructed of two annular portions 114 and 115 symmetrical with respect to a clearance gap 113 in the hammer lever 112 with edges of the annular portions 114 and 115 held against the end surfaces 110 and 111 of the shaft 106.

The hammer turning mechanism shown in FIG. 10 also can turn the hammer lever 107 and hence the hammer 7 smoothly in coaction with movement of the solenoid shaft 106 of the solenoid 105.

FIGS. 11(*a*) through 11(*e*) show a correcting mechanism according to another embodiment. FIG. 11(*a*) shows a hammer head in perspective; FIG. 11(*b*) is a rear elevational view of a portion of the type wheel; FIG. 11(*c*) a fragmentary side elevational view showing a standby position; FIG. 11(*d*) a fragmentary side elevational view showing a printing operation; and FIG. 11(*e*) a fragmentary side elevational view showing a correcting operation.

As illustrated in FIG. 11(*a*), a hammer 116 has a recess 118 defined in a front surface of a head thereof and having tapered surfaces 117, and ledge 119 positioned downwardly of the recess 119 for striking the correcting ribbon. The ledge 119 has a width 120 sufficiently larger than the width of a character to be printed on a paper sheet. As depicted in FIG. 11(*b*), a type wheel 121 has clearance gap 124 defined between adjacent type fonts 122 and 123 for passage therethrough of the hammer 116 shown in FIG. 11(*a*). The ledge 119 and the clearance gap 124 jointly constitute a correcting mechanism.

Immediately prior to a printing operation, the type font 123, for example, is placed in confronting relation to the ink ribbon 30 as shown in FIG. 11(*c*), with the hammer 116 confronting the type font 123. When the printing operation is started, the type font 123 is struck by the hammer 116 with a recess 118 in the hammer 116 engaging a ridge 125 on the back of the type font 123, as illustrated in FIG. 11(*d*). The type font 123 now pushes the ink ribbon 30 to print a desired character on the print paper sheet 29.

For correcting a printed character, the type wheel 121 is controllably rotated to bring the clearance gap 124 into confronting relation to the hammer 116 as shown in FIG. 11(*b*), and then the correcting ribbon 31 is struck by the ledge 119 of the hammer 116 as shown in FIG. 11(*e*). At this time, the carriage on which the hammer 116 is mounted may be held at rest, and the platen 1 may be turned in small angular increments to move the print paper sheet 29 in the direction of the arrow 126 while the correcting ribbon 31 is being struck by the ledge 119 a number of times.

The ledge 119 on the hammer 116 is dimensioned not to contact the spokes supporting the type fonts in a printing operation, and to strike the correcting ribbon 31 reliably in a correcting operation.

The correcting mechanism shown in FIGS. 11(*a*) through 11(*e*) can effect substantially the same correcting operation as that of the correcting mechanism of the previous embodiment.

FIG. 11(*f*) is a perspective view of a hammer head according to another embodiment. A hammer 117 shown in FIG. 11(*f*) has a recess 129 defined in a front end thereof and having tapered surfaces 128, and a ledge 130 located below the recess 129 for strucking a correcting ribbon. The ledge 130 has a height 131 sufficiently greater than the height of a character to be printed on a print paper sheet 29.

With a correcting mechanism having the hammer 127 shown in FIG. 11(*f*) rather the hammer 116 shown in FIG. 11(*a*), it is preferable to keep the platen and hence the print paper sheet 29 at rest and enable the ledge 130 to hit the correcting ribbon a number of times while the carriage on which the hammer 127 is mounted is being moved through slight intervals.

Figure 12:
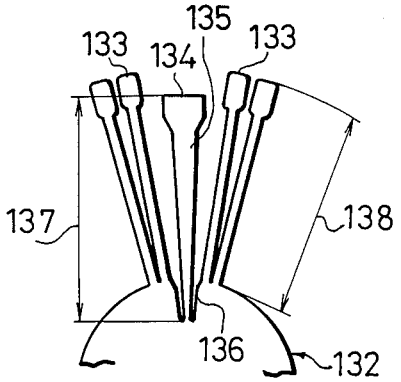
FIG. 12 is a fragmentary front elevational view of still another correcting mechanism.

FIG. 12 illustrates a correcting mechanism according to still another embodiment of the present invention. A type wheel 132 includes type fonts 133, a correcting character 134 disposed between adjacent type fonts 133 and positioned in a location lower than the type fonts 133, and a correcting spoke 135 supporting the correcting character 134 and integral with the type wheel 132. The type wheel 132 also has recesses 136 defined therein on opposite sides of a proximal end of the correcting spoke 135 remote from the correcting character 135. The correcting spoke 135 and the correcting character 134 have a combined length 137 equal to the combined length 138 of a spoke and one of the type fonts 133 supported thereon. A hammer for hitting the correcting character 134 may be of the same construction as that of the hammer 7 shown in FIG. 2(*b*).

With the correcting mechanism thus constructed, the length 137 of the correcting spoke 135 and correcting character 134 may be selected to be sufficiently great so that stresses imposed on the proximal end of the correcting spoke 135 at the time the hammer strikes the correcting character 134 can be reduced. Therefore, the correcting spoke 135 is reliably prevented from being damaged.

The recesses 136 may be of other shapes than that illustrated in FIG. 12. For example, the proximal end of the correcting spoke 135 may be thicker than shown in FIG. 12.

The rotary wheel printer of the above construction according to the present invention is of a reduced height, and hence is lower in profile and smaller in size than conventioanl rotary wheel printers.

Although certain preferred embodiments have been shown and described, it should be understood that many changes and modifications may be made therein without departing from the scope of the appended claims.

What is claimed is:

1. A rotary wheel printer according to claim 1, wherein said hammer means has an engagement portion on a distal end thereof, said type wheel having positioning portions on rear surfaces of said type elements and correction section for engagement with said engagement portion of said hammer means, said type wheel also having a recess at a proximal end of said correcting spoke.

2. A rotary wheel printer according to claim 1, wherein said hammer means has an engagement portion on a distal end thereof, said type wheel having positioning portions on rear surfaces of said type elements and correction section for engagement with said engagement portion of said hammer means, said type wheel also having a recess at a proximal end of said correcting spoke.

3. A rotary wheel printer according to claim 1, wherein said type wheel has a plurality of radial spokes each supporting respective type elements on distal ends thereof, said hammer means having a ledge and means including a clearance gap defined between adjacent ones of said radial spokes and serving as said correcting section for moving said ledge through said clearance gap to strike said correcting ribbon and to correct the printed character when said hammer means is aligned with said clearance gap.

4. A rotary wheel printer according to claim 1, wherein said hammer means is actuated to press said correcting ribbon a number of times in a series of partial corrections against the printed character for correcting the same on the paper sheet while turning said platen about its own axis through small angular intervals.

5. A rotary wheel printer according to claim 1, wherein said hammer means is actuated to press against said correcting ribbon a number of times in a series of partial corrections against the printed character for correcting the same on the paper sheet while moving said carriage through small lateral intervals.

6. A rotary wheel printer according to claim 1, including means on said ribbon cassette for supporting therein said ink ribbon and said correcting ribbon movable in a first direction perpendicularly to a second direction in which the paper sheet is fed, said ink ribbon and said correcting ribbon being exposed parallel to said type wheel and to each other.

7. A rotary wheel printer according to claim 6, wherein said ink ribbon is wound in said ribbon cassette, said correcting ribbon being endless and extending around said ink ribbon, said ribbon feeder means comprising a mechanism for moving said ink ribbon and said correcting ribbon in said first direction in coaction with each other.

8. A rotary wheel printer according to claim 1, including a motor as said first drive means for turning said type wheel, said motor and said type wheel being inclined with respect to a horizontal plane, said ribbon cassette having guide portions for guiding said ink and correcting ribbons, said guide portions being disposed in confronting relation to said type wheel and inclined at an angle at which said type wheel is inclined.

* * * * *

UNITED STATES PATENT AND TRADEMARK OFFICE

CERTIFICATE OF CORRECTION

PATENT NO. : 4,856,921

DATED : August 15, 1989

INVENTOR(S) : Osamu Hatakeyama

It is certified that error appears in the above-identified patent and that said Letters Patent is hereby corrected as shown below:

Column 11, delete the entire printed Claim 1 and substitute therefor:

1.-- A rotary wheel printer comprising:

(a) a rotatable platen adapted to have a paper sheet wound partially therearound for printing thereon, said platen being rotatable to bring the paper sheet to one position for printing a character and to another, correcting position for correcting a printed character;

(b) a carriage movable along said platen;

(c) a type wheel mounted on said carriage in confronting relation to said platen and having a plurality of radial spokes supporting type elements on distal ends thereof at one radial distance from the center of the type wheel, and a spoke supporting a correcting section on a distal end thereof at a different radial distance from the center of the type wheel than that of the type elements;

(d) first drive means mounted on said carriage for rotating said type wheel about its own axis to bring a selected type element or said correcting section into a printing position;

UNITED STATES PATENT AND TRADEMARK OFFICE

CERTIFICATE OF CORRECTION

PATENT NO. : 4,856,921

DATED : August 15, 1989

INVENTOR(S) : Osamu Hatakeyama

It is certified that error appears in the above-identified patent and that said Letters Patent is hereby corrected as shown below:

(e) a hammer means mounted on said carriage for striking a selected type element or said correcting section in said position;

(f) second drive means mounted on said carriage for driving said hammer means;

(g) ribbon feeder means for successively feeding an ink ribbon accomodated in a ribbon cassette mounted on said carriage and a correcting ribbon accomodated in said ribbon cassette;

(h) third drive means mounted on said carriage for driving said ribbon feeder means; and (i) correcting means comprising said correcting section of said type wheel, said correcting ribbon, said hammer means, and rotation of said plated to said correcting position for correcting a printed character on the paper sheet.--

Signed and Sealed this

Twenty-fourth Day of July, 1990

*Attest:*

*Attesting Officer*

HARRY F. MANBECK, JR.

*Commissioner of Patents and Trademarks*